United States Patent [19]

Blake

[11] 4,155,487

[45] May 22, 1979

[54] TRIGGER SPRAYER

[76] Inventor: William S. Blake, 6570 Lake Blue Dr., Miami Lakes, Fla. 33014

[21] Appl. No.: 831,713

[22] Filed: Sep. 9, 1977

[51] Int. Cl.[2] ..... B65D 37/00

[52] U.S. Cl. ..... 222/207; 222/213; 222/214; 222/383

[58] Field of Search ..... 222/382, 207, 209, 211, 222/212, 213, 214, 215, 383, 384, 321; 239/333; 417/480

[56] References Cited

U.S. PATENT DOCUMENTS

| | | | |
|---|---|---|---|
| 3,486,663 | 12/1969 | Humphrey | 222/207 |
| 3,561,648 | 2/1971 | Humphrey | 222/207 |
| 3,726,442 | 4/1973 | Davidson et al. | 222/207 |
| 3,986,644 | 10/1976 | Grogan et al. | 222/207 |
| 3,995,774 | 12/1976 | Cooprider et al. | 222/207 |

*Primary Examiner*—Allen N. Knowles
*Attorney, Agent, or Firm*—Knobbe, Martens, Olson, Hubbard & Bear

[57] ABSTRACT

In one trigger operated dispenser pump a variable volume pump chamber is formed by a flexible bulb having a flange on its upper end which serves as a gasket and carries depending flaps which form inlet and outlet check valves for the chamber. In two other arrangements, the pump chamber is formed by a piston and cylinder and the valve element is a separate member surrounding a cavity open to the pump chamber. A novel vent valve permits replacement air into the container on which the pump is used.

20 Claims, 11 Drawing Figures

FIG. 10.
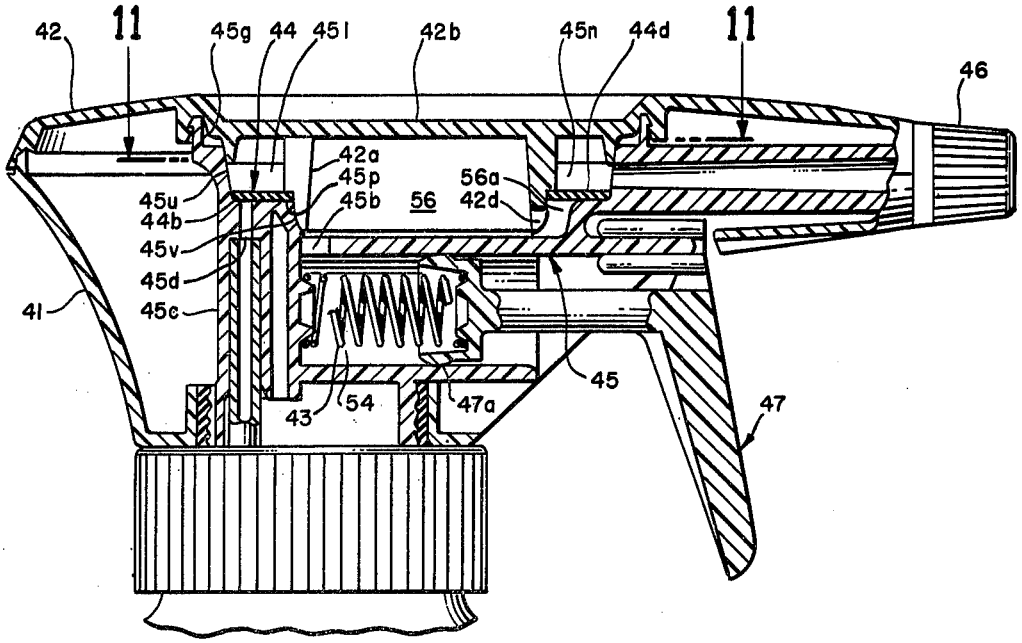
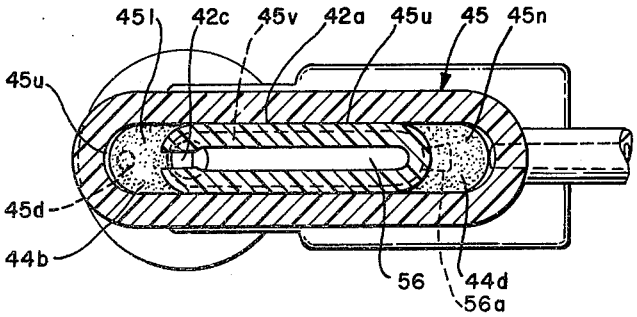
FIG. 11.

TRIGGER SPRAYER

This invention relates to fluid dispensing pumps of the type having a variable pump chamber provided by deforming a resilient bulb or displacing a piston within a cylinder. More particularly, the invention relates to an improved valving arrangement and other construction features of such pumps.

A wide variety of manually operated pumps have been developed for dispensing material from containers for a large number of different products. Although such pumps have been becoming more sophisticated and numerous improvements have been made in their design, a need still exists for further improvements in costs and reliability, particularly in view of the high volume production of such items, and in view of the trend away from aerosol valves.

In U.S. Pat. No. 3,986,644 and 3,995,774 there are disclosed dispensing pumps of the type wherein a diaphragm or bulb forms the pump chamber which is deformed to provide the pumping action by operating a trigger. The bulbs have a large and outwardly extending flange on their upper portion which is clamped between a pair of housing members. Portions of this horizontally extending flange form flexible inlet and outlet valve elements which cooperate with passages in the housing for controlling flow into and out of the pump chamber. There are a number of advantages of the pumps disclosed but there are also some shortcomings.

In these patents a plate closes the pump chamber and compresses the resilient flange to provide a large flat sealing area to separate the inlet side of the chamber from the outlet side. The plate is formed with passages to permit fluid flow and to permit movement of the valve elements. Thus, the outlet valve seals against the plate. To provide flat seal, it is necessary to hold the plate tightly against the resilient flange, which sometimes restricts the proper movement of the valve elements.

In one version of this product, the upper housing wall has been made quite thin to reduce size and the amount of material needed. The upper housing is attached to the lower housing section by ultrasonic welding or other bonding means. The pump pressures tend to make the thin housing wall bulge in the center which weakens the bond around the periphery, with a resultant tendency to leak. The pressure which exists around the periphery of the flange in the area where the valving occurs further introduces stresses in that area which may cause leakage problems, as well as valve interference. Accordingly, a need exists for improving the valving and valve housing construction in pumps of this general type employing variable volume chambers.

In accordance with the present invention, a pump housing is formed with an upwardly opening cavity which is closed by a cover having depending walls which cooperate with to separate housing inlet passages and outlet passages. A variable volume pump chamber is open to the cavity. A flexible valve element is clamped between the housing and the cover to control flow through the passages, and there is ample space to provide proper valve movement. Also, the valve element always seals against the first housing. In one form of the invention, the valve element is formed integral with a flexible bulb which forms the pump chamber. The bulb is captured within the housing and the upper end of the bulb is closed by the cover.

In other forms of the invention, the variable pump chamber is formed by a piston which slides within a cylinder formed in the pump housing; and the valve element surrounding the cavity in the housing is a separate member.

In the resilient bulb and one of the piston and cylinder versions of the invention, the flexible valve elements depend from the resilient gasket and extend vertically. Consequently, these valve elements flex laterally or horizontally in cooperation with valve passages in the valve housing. As a result, the cover sealing forces cannot interfere with valve movement. Also, with the valving below the gasket and moving horizontally as opposed to vertically, the pressure in the immediate valving area tends to improve the seal of the gasket rather than detract from the seal. In the third arrangement, the valving is horizontal, but ample space is provided such that the closing of the cover does not interfere with the valve movement.

Another feature of the invention relates to an improved arrangement for venting the container to permit air to enter the container to replace product as it is withdrawn by the pump. Additionally, the variable volume pump chambers are preferably operated by trigger levers and improved arrangements are disclosed for mounting such triggers.

For a more thorough understanding of the invention refer now to the following detailed description and drawings in which:

FIG. 10 is a cross-sectional view of a third embodiment of the invention employing a different valving arrangement; and FIG. 11 is a cross-sectional view on line 11—11 of FIG. 10.

Figure 1:
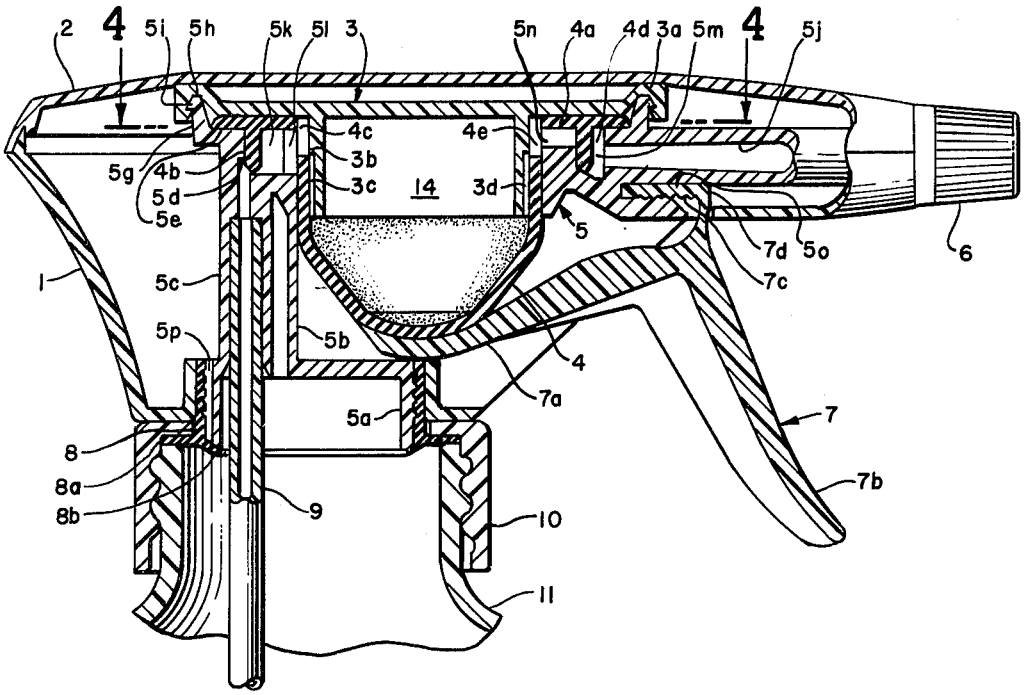
FIG. 1 is a vertical cross-sectional view of one embodiment of the invention employing a flexible bulb as the dispensing chamber.

Referring now to FIGS. 1–5, the trigger sprayer unit shown therein may be seen to include a bottom fairing 1, a top fairing 2, a bulb retainer plate 3, a bulb with valve elements 4, a valve housing 5, a nozzle 6, a trigger lever 7, an adapter element 8, a dip tube 9, and a cap or closure 10 which threads onto the upper end of a container 11.

The valve housing 5 may be seen to be an irregularly shaped member molded of rigid plastic and having a lower tubular portion **5*a* which is exteriorly threaded or having a series of circular bead rings to fit within the collar-like adapter 8. The adapter has an outwardly extending flange 8***a* which rests on the open upper end of the neck of the container 11. The adapter further has an inwardly extending flexible flange or flap 8*b* which engages the lower edge of the valve housing tubular portion 5*a*. The adapter 8 with the valve housing 5 is captured on the open upper end of the container by the cap 10.

The valve housing 5 further includes an upwardly extending tubular portion 5*b* having an internal inlet tubular passage 5*c*, which is open at its upper end to define an inlet valve opening and surrounding valve seat 5*d*. As can be seen from FIG. 1, the inlet opening 5*d* is essentially in the side wall of the inlet tube 5*c*.

Figure 2:
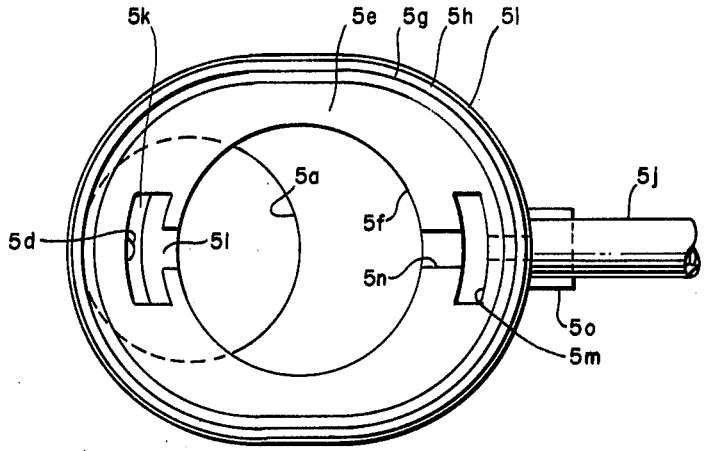
FIG. 2 is a top plan view of the main housing of the dispenser with the bulb removed.
Figure 3:
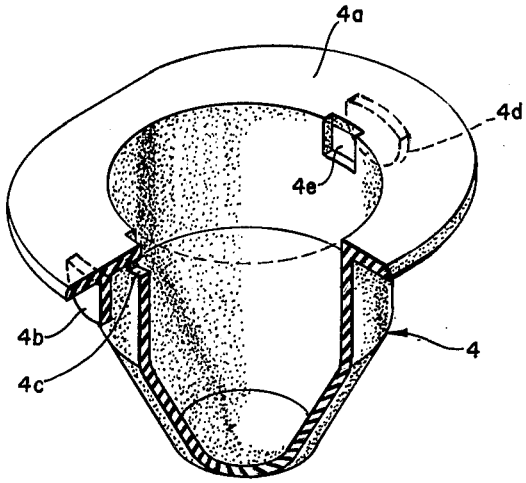
FIG. 3 is a perspective partially sectionalized view of the bulb of the dispenser of FIG. 1.

The valve housing 5 further has an upper wall 5*e* having a generally circular interior opening 5*f* as seen in FIG. 2, and an exterior generally elliptical or race-track shape. An upwardly extending, slightly outwardly sloping housing wall 5*g* defines an upwardly opening cavity with an upper edge 5*h*. The exterior of the wall 5*g* extends downwardly and outwardly to form a peripheral lip 5*i*. The valve housing 5 also includes an integrally formed product outlet tube 5*j*.

Positioned within the circular opening 5*f* in the valve housing 5 is the bulb member 4 having a main central bulb portion having a closed bottom and side walls forming a bulb chamber 14. The bulb member 4 further has an open upper end with an outwardly extending flange 4*a* which is positioned on the valve housing wall 5*e*. The main portion of the bulb 4 which defines the chamber 14 fits snugly within the housing portion defining the hole 5*f*.

Figure 4:
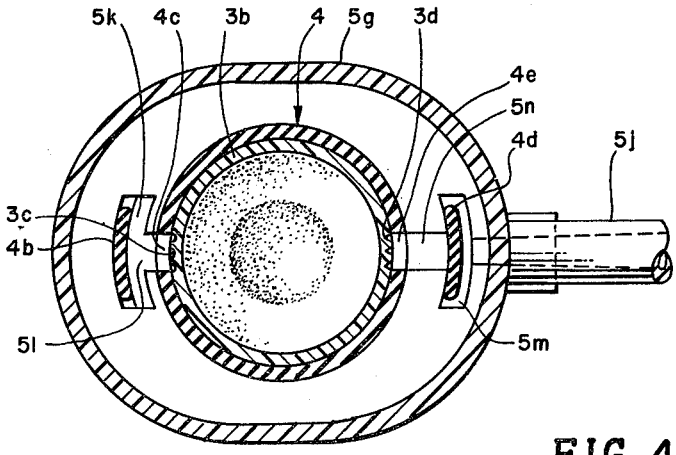
FIG. 4 is a cross-sectional view on line 4—4 of FIG. 1 showing the valve elements of the flexible bulb adjacent the valve openings in the main housing.

The bulb member 4 is further provided with an inlet flap valve 4*b* which depends from the flange 4*a* and fits within a slot 5*k* formed in the valve housing 5 as may be seen in FIGS. 1, 2 and 4. The lower end of the valve flap 4*b* closes the valve inlet opening 5*d*. The slot 5*k* in the housing opens into an inlet passage 51 in the housing 5 which is closed on its upper side by the flange 4*a*. The side wall of bulb member 4 has a valve port aligned with the passage 51 in the housing.

Similarly, the bulb member 4 has an outlet valve element or flap 4*d* on the opposite side of the bulb member which fits within a slot 5*m* on the outlet side of the housing 5. The lower end of the inner side of the valve element 4*d* closes a passage 5*n* opening to the slot 5*m*, the passage 5*n* and slot 5*m* being closed from above by the flange 4*a*. The side wall of the bulb member 4 is further provided with an outlet port 4*e* which is aligned with the inner end of the outlet passage 5*n* in the housing.

As can be seen from FIG. 1, the bulb retainer plate 3 extends over the open upper end of the bulb chamber 14 and engages the outer flange 4*a* of the bulb to close the bulb chamber and hold the bulb in position in the valve housing. The retainer plate 3 has a peripheral annular groove 3*a* which fits over the open upper end of the valve housing wall 5*h* and is captured in this position by snapping over the lip 5*i*. Centrally formed on the retainer plate 3 is a depending cylindrical wall 3*b* which fits within the open upper end of the bulb 4. As can be seen from FIG. 1, the wall 3*b* extends inwardly into the bulb about to the location where the bulb begins to taper inwardly and downwardly. Thus, the cylindrical wall 3*b* plus the central portion of the upper wall of the retainer plate form the upper walls of the chamber 14. The wall 3*b* fits closely so as to press the bulb against the housing wall 5*f* to prevent leakage between the bulb and the housing.

Formed on the exterior of the cylindrical wall 3*b* on the left or rear side are three vertically extending grooves or slots 3*c* which are circumferentially aligned with the inlet 4*c* in the bulb wall and are open at the upper end to the inlet 4*c* to form inlet passages for the product. The lower ends of the grooves 3*c* open to the bulb chamber 14. Also formed on the exterior of the cylindrical wall 3*b*, 180° from the grooves 3*c*, are grooves 3*d*, as seen in FIG. 4, which are circumferentially aligned and open at their upper ends with the outlet 4*e* in the bulb 4 and aligned with the outlet passage 5*n* in the valve housing. The grooves 3*c* and 3*d* thus form restricted inlet and outlet ports for the chamber 14.

The bulb 4 is actuated or squeezed by the trigger lever 7 which has a depending finger 7*a* which on its rearward most portion is shaped to fit the lower end of the bulb member 4. A finger grip portion 7*b* extends downwardly and forwardly for convenient gripping by the user of the dispenser in trigger fashion. The trigger lever 7 is held in this position by a retainer tongue 7*c* formed on the upper portion of the trigger lever and fitting within a slot 5*o* formed in the valve housing 5, beneath the outlet tube 5*j*. The flange 7*c* is connected to the main body of the trigger 7 by means of a so-called "living hinge" 7*d* which permits the trigger to hinge about that joint.

The valve housing 5 and the bulb retainer plate 3 are enclosed within the bottom and top fairings 1 and 2 which mate together to form a smooth exterior appearance. The lower end of the bottom fairing 1 is formed with an upwardly extending collar which fits over the sleeve-like adapter member 8 to properly position the fairing. The nozzle 6 slips over the tubular housing portion formed by the top and bottom fairing.

In operation, when the trigger 7 is pulled, it pivots about its living hinge 7*d* causing the finger 7*a* to distort the bulb lower portion upwardly to decrease the size of the bulb chamber 14. This action forces product that was in the bulb upwardly through the outlet grooves 3*d* in the cylindrical wall 3*b* of the retainer plate 3. The product can then exit under pressure through the bulb port 4*e* in the bulb side wall and into the outlet passage 5*n* in the valve housing. At this point it encounters the valve element 4*d*; and because there is room in the slot 5*m* in the valve housing downstream of the valve, the pressure of the product pushes the lower end of the flexible valve element outwardly away from the outer end of the passage 5*n* as illustrated in FIG. 5, so that product can escape into the outlet tube 5*j* and out the spray nozzle 6 as shown at 18 in FIG. 5.

Figure 5:
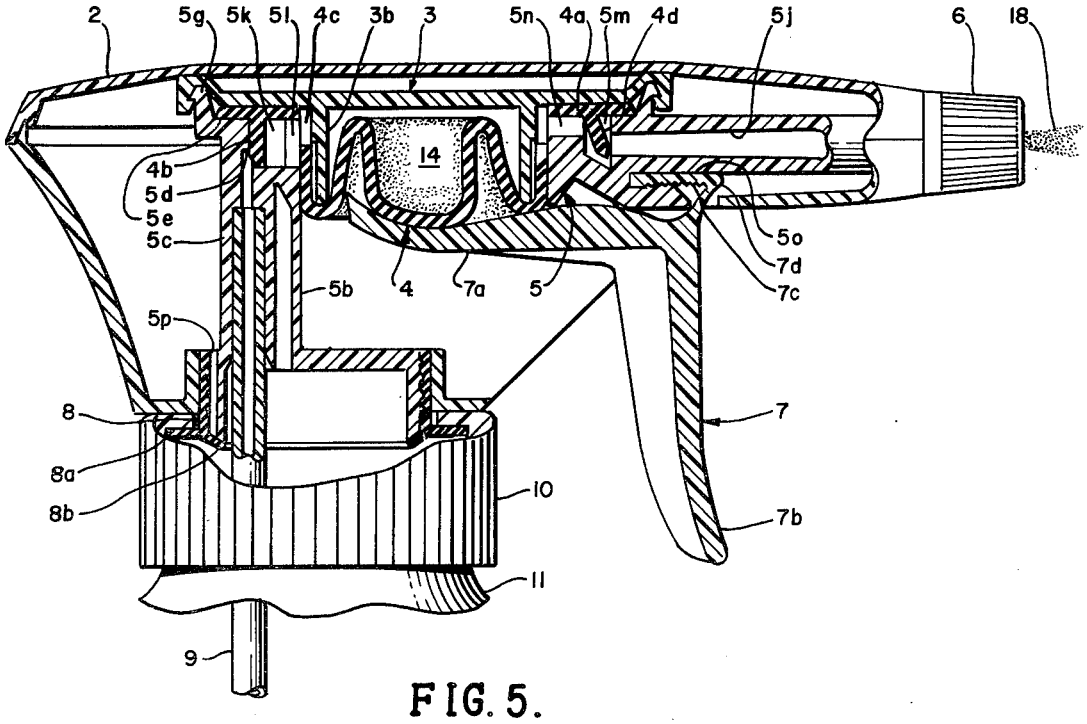
FIG. 5 is a cross-sectional view similar to FIG. 1 showing the dispenser bulb in dispensing position squeezed by the trigger.

When the bulb is in its collapsed position shown in FIG. 5, product is also urged to escape from the chamber 14 by way of the inlet passages 3*c* and into the inlet compartment 51. However, the pressure of the product simply urges the inlet valve 5*d* more tightly into closed position as shown in FIGS. 1 and 2. Thus, the product cannot escape back into the container.

When the trigger is released, the resiliency and memory of the bulb 4 causes it to quickly snap to its original shape as illustrated in FIG. 1. This produces a vacuum within the chamber 14. Once the pressure within the chamber is relieved, the flexible outlet valve 4*d* snaps back into its closed position as shown in FIG. 1, and the vacuum which is then created tends to pull the outlet valve more tightly closed so that product cannot escape from the outlet. However, on the inlet side, the vacuum created within the chamber pulls the lower end of the flexible inlet valve 4b away from the inlet 5d in the valve housing so that the suction is applied to the open upper end of the inlet valve housing inlet tube 5c and the product dip tube 9. Consequently, product is sucked upwardly through the tube 9, the housing tube 5c, the housing 51 the bulb inlet port 4c downwardly through the inlet grooves 3c and finally into the chamber 14. The trigger sprayer unit is then ready to be operated once again by pulling on the trigger 7.

As product is withdrawn from the container, a slight vacuum is created within the container 11 causing the inwardly extending flap of flange 8b of the vent adapter 8 to be drawn downwardly away from the lower end of the cylindrical housing wall 5a. This permits air to be drawn into the container through the groove 5p in the exterior of the wall 5a. The interior of the fairings 1 and 2 is open to the exterior through various spaces including those where the trigger passes through a slot in the bottom fairing 1. When the incoming air has replaced the product, the flap 8b returns, due to its resiliency, to the position shown in FIG. 1 so that the product within the container does not evaporate or dry out.

Refer now to the embodiment of FIGS. 6–9 for a description of another form of the invention which is similar to the one described above, but a variable pump chamber 34 is created by a piston and cylinder arrangement rather than a flexible bulb. The unit includes a bottom fairing 21, a top fairing and retention plate 22, a spring 23, a valve element 24, a valve housing 25, a nozzle 26, a trigger member 27, an adapter/vent member 28, a dip tube 29 and a closure or cap 30.

Figure 6:
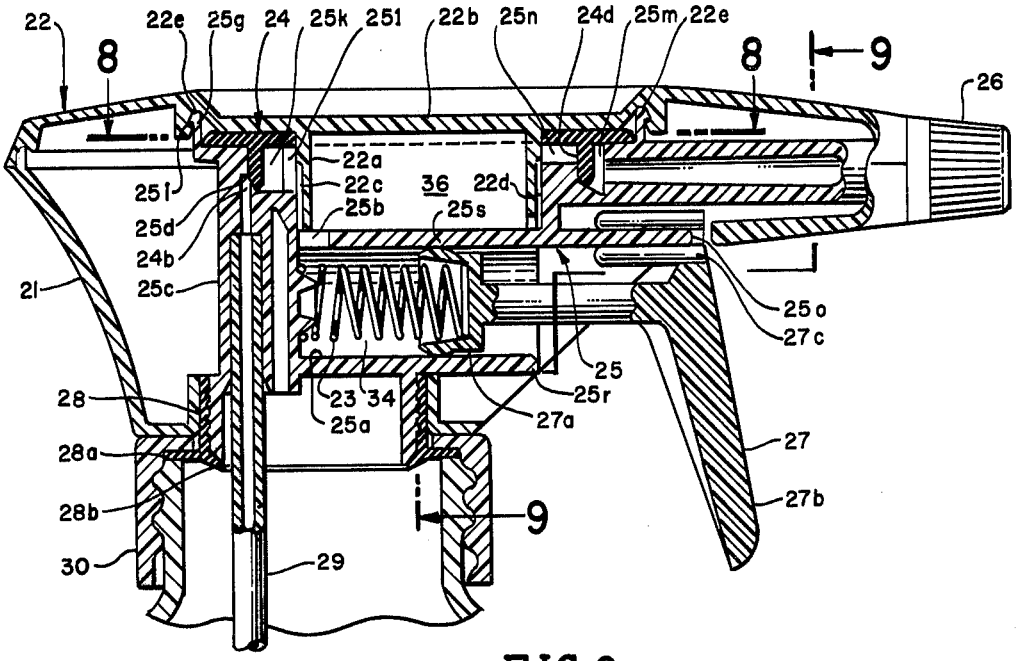
FIG. 6 is a cross-sectional view of a second embodiment of the invention wherein the variable dispensing chamber is formed by a piston within a cylinder.

The valve housing 25 is provided with a horizontally extending cylindrical portion 25a which in combination with a piston 27a defines a variable volume chamber 34. The spring 23 urges the piston to its outer position wherein the chamber 34 is at its maximum as illustrated in FIG. 6. An opening 25b in the rear upper wall of the cylinder 25a places the chamber 34 in communication with an upper product chamber 36. This chamber 36 is defined by a lower wall 25s forming a portion of the housing 25, a vertical side wall 22a formed integral with the retainer plate 22, and an upper wall 22b which is the central portion of the retainer plate. The plate which also forms the top fairing, includes an annular groove 22e which fits over an upwardly extending wall 25g, the proper portion of an upwardly opening cavity in the housing 25 of which the chamber 36 is a part. A lip on the retention plate snaps over a slip 25i of the housing upper wall 25g.

Figure 8:
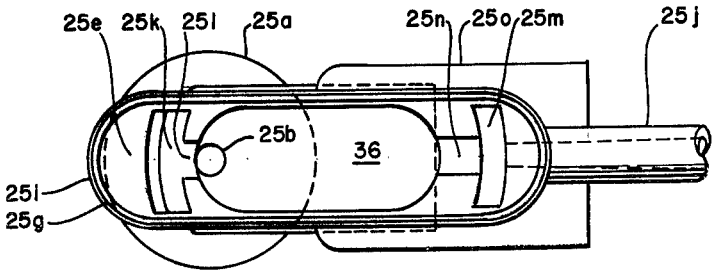
FIG. 8 is a top plan view of the main housing of the dispenser of FIG. 6.

As seen from FIG. 8, the chamber 36 formed by the valve housing and the plate 22 has an elongated shape with an inlet passage 25l in the rear upper portion of the housing wall 25e forming the chamber 36. This passage 25l opens into a larger slot 25k. Similarly, at the opposite end of the chamber 36 there is s an outlet passage 25n in the housing wall 25e, which communicates with an outlet slot 25m, that further leads to an outlet tube 25j leading to the nozzle 26. The rear outer portion of the vertical wall 22a is formed with a plurality of axially extending grooves 22c and the opposite end of the exterior of the wall 22a is formed with vertically extending grooves 22d. The lower end of the wall 22a adjacent the vertical slots 22d is cut away so that the chamber 36 is in communication with the lower end of the grooves 22d. The lower end of the grooves 22c open into the port 25b.

Figure 7:
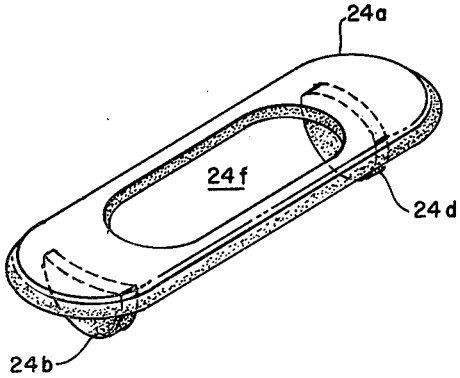
FIG. 7 is a perspective view of the flexible gasket valve element of the dispenser of FIG. 6.

The valve element 24 may be seen from FIG. 7 to have an elongated race-track configuration with an elongated opening 24f in its center. The element 24 rests on the upper wall 25e of the housing surrounding the chamber 36 in the housing. The gasket valve element 24 is captured between this wall 25e and the fairing retention plate 22 to prevent leakage out of the housing and to separate the inlet and outlet of the housing cavity, and the chamber 36 together with the depending wall 22a. The element 24 is provided with a depending inlet valve flap 24b which closes the opening 25d at the upper end of the inlet tube 25c formed in the housing. Similarly, the valve element has a depending outlet valve flap 24d which closes the outlet 25n.

Figure 9:
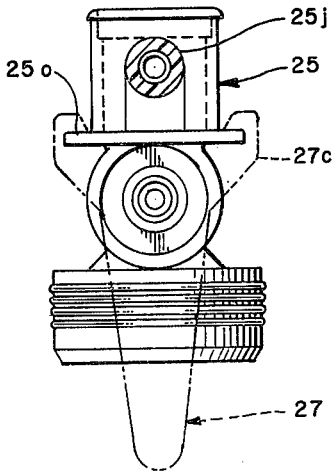
FIG. 9 is a partially sectionalized view on line 9—9 of FIG. 6 showing the configuration of the valve housing, and with the trigger shown in broken lines.

The trigger 27 may be seen from FIG. 9 to have a pair of side guide members 27c which slide on the outwardly extending edges of a flange 25o. The flange slidably supports the trigger 27 during its horizontal plunger type movement.

In operation, depressing the trigger moves the piston rearwardly as viewed in FIG. 6 compressing the product within the chambers 34 and 36 and also compressing the spring 23. This compressed product is forced upwardly through the grooves 22d, outwardly through the opening 25n, forcing the valve element 24d into an open position so that the product may flow into the outlet tube 25j and out the nozzle 26. The pressure of the product forces the inlet valve 24b to remain in its closed position. Releasing the trigger causes the spring 23 to return the piston 27a to the position shown in FIG. 6. This creates a vacuum in the chambers 34 and 36 causing product to be sucked up the dip tube 29 passed the inlet valve 24b and into the variable pump chamber 34. The trigger can then be depressed again for another pump cycle. As the product is withdrawn from the container, the adapter vent flange 28b is drawn downwardly permitting air to be admitted into the container.

Refer now to the embodiment of FIGS. 10 and 11 for a description of another form of the invention which is similar to the embodiment of FIGS. 6–9, but employs a different valving arrangement. The valve housing 45 as in the other embodiments is an irregularly shaped member preferably molded as a single member made of rigid plastic. The housing 45 includes walls which define an upwardly open cavity with the upper portion formed by the generally vertically extending side walls 45g, 45u and 45v. This cavity is closed by a cover 42 and more particularly the central platelike portion 42b of the cover. The cover is provided with a grooved portion adapted to fit over the upper edge of the housing wall 45g. The cover 42 further includes a depending, elongated wall 42a which fits within the lower portion of the cavity engaging the wall 45v and the wall 45u on the elongated sides, as seen in FIG. 11. On the ends, the exterior of the wall 42a is spaced from the housing wall to define an inlet compartment or passage 451 and an outlet compartment or passage 45n. The interior of the wall 42a defines a chamber 56 which with the compartments 45l and 45n forms part of the cavity in the upper part of the housing. This chamber 56 is in communication with, and in effect forms a part of, the variable volume pump chamber 54 through an opening 45b. The chamber 54 being formed by a piston 47a within a cylinder in the housing 25 similar to that in FIG. 6. The piston 47a forms a part of a trigger 47 which is slidably mounted on the housing.

As best seen from FIG. 11, the cover side wall 42a has a slot 42c which connects the chamber 56 to the inlet passage 45*l*. On the other side of the chamber 56 the side wall 42*a* has a notch 42*d* at its lower end which opens to a recess 56*a* and connects the chamber to the passage 45*n*. Clamped between the housing shoulder or horizontal wall 45*p* and a portion of the exterior of the side wall 42*a* of the cover is a flat flexible valve element 44. As seen from FIG. 11, the cover side walls 42*a* extend across the housing cavity to separate the inlet passage 45*l* from the outlet passage 45*n*. The inlet end of the valve element 44 extends over the housing inlet passage 45*d* to serve as an inlet check valve. On the other side of the chamber 56, the outlet end 44*d* of the valve element 44 extends across the passage 56*a* and serves as an outlet check valve for permitting flow out of the chamber while preventing reverse flow.

The operation of the embodiment of FIGS. 10 and 11 is essentially like that of the earlier embodiments. Squeezing the trigger 47 decreases the size of the pump chamber 54 so that any product in the chamber is squeezed past the outlet check valve 44*d* and out the nozzle 46. The check valve element 44*b* prevents flow into the inlet tube 45*d*. When the trigger is released, the spring 43 urges the triggerpiston 47*a* outwardly into the position shown in FIG. 10, thus increasing the volume of the chamber 54. This creates a slight vacuum within the chamber 54, the chamber 56 and the inlet passage 45*l*. As the trigger is released, the check valve 44*d* closes due to its inherent flexibility, and the vacuum created within the chamber 56 holds the check valve 44*d* in its closed position as shown in FIG. 10. On the other hand, the vacuum within the chamber 56 is applied to the upper side of the inlet check valve 44*b* causing it to flex upwardly so that the suction is applied to the inlet tube 45*d*. This in turn draws the additional product from the container into the pump chamber 54.

An advantage of the valve element in this arrangment is that the element need not be very resilient to perform its function. Thus, the element may be made of flexible plastic and may be formed by stamping, which is less costly than having an element of molded rubber.

A significant advantage of all the arrangements described is that of not having any critical dimensions in the valving. Using the FIG. 6 arrangement as an example, as pressure increases within the pump chamber 36 when the trigger is depressed, there is some tendency for the cover plate 22*b* to bulge slightly. However, this does not affect operation of the valving since that is between the valve element and the housing. Also, the dependent wall 22*a* minimizes the possibility of leakage from the chamber. The bulging effect outwardly near the gasket 24 and lid groove 22*e* is not significant. In each of the embodiments, the components are easily assembled. housing slot

What is claimed is:

1. A dispenser pump comprising:

a housing having wall means defining an internal cavity open on its upper end, means forming an inlet passage connecting the cavity to a container holding the product to be dispensed, and means forming an outlet passage connecting said cavity and an outlet nozzle;

means defining a variable volume pump chamber open to said cavity;

a cover plate closing the open upper end of said cavity having means cooperating with said housing to separate said inlet passage from said outlet passage; and a flexible valve element captured between said cover and said housing having an inlet portion sealing against said housing to close said inlet passage and an outlet portion sealing against said housing to close said outlet passage, said inlet portion permitting flow into said chamber but preventing flow out of said chamber, and said outlet portion permitting flow out of said chamber and preventing flow into said chamber.

2. The pump of claim 1 wherein said pump chamber is formed by a deformable member mounted within said housing member.

3. The pump of claim 2 wherein said valve element is a flange on the upper end of said member.

4. The pump of claim 3 wherein said member is open on its upper end which is closed by said plate, and the periphery of said flange is captured between said cover and housing to form a seal for said cavity.

5. The pump of claim 3 wherein said member has an inlet port in its side wall connecting the chamber to said inlet passage and an outlet port connecting the chamber to said outlet passage.

6.The pump of claim 2 wherein said member is a resilient bulb and said plate has depending walls which are positioned within said chamber to hold the bulb against the surrounding housing wall.

7. The pump of claim 1 wherein said valve element has a thin flat upper portion with said valve inlet and outlet portion depending from said upper portion.

8. The dispenser pump of claim 1 wherein said valve element has a thin flat configuration with one side of the element forming said inlet portion and the opposite side forming said outlet portion.

9. The dispenser pump of claim 1 wherein said valve element has a central opening and part of said cover plate extends through said opening in holding said element against said housing.

10. The dispenser pump of claim 1 wherein said variable volume chamber is formed by a piston slidable within a cylinder formed in the housing, with said cylinder being open to said cavity.

11. The dispenser pump of claim 10 wherein said variable volume chamber is located in said housing below said cavity.

12. The dispenser pump of claim 11 including a trigger slidably mounted on said housing to move said piston in said cylinder.

13. A dispenser pump to be mounted on a container for dispensing product from the container comprising:

a valve housing to be mounted on the container outlet;

means within said housing defining a variable volume pump chamber including a retainer plate attached to said housing closing said chamber;

flat resilient gasket means clamped between said plate and said housing;

means defining an inlet passage leading into said chamber and an outlet passage leading out of said chamber;

a flexible flap depending from said gasket and extending into said inlet passage to form an inlet valve element normally closing said inlet passage, the walls of said inlet passage permitting the flap to flex in a direction to permit flow into said chamber from said container but preventing the flap to flex in a direction to permit flow out of the chamber; and a flexible flap depending from said gasket into said outlet passage forming an outlet valve element normally closing said outlet passage, the walls of said outlet passage permitting the outlet flap to flex in a direction to permit flow out of said chamber but to prevent flow into the chamber.

14. A dispenser pump comprising:

a valve housing;

a flexible bulb within a space in said housing defining a variable volume pump chamber together with a retainer plate attached to said housing and closing the chamber, said retainer plate including a horizontal flat central portion and a vertically extending circumferential wall which extends into said chamber so that the vertical wall and the flat wall form the upper portion of the side walls of the chamber and the flat portion forms the top wall of the chamber;

means defining an inlet port to said chamber in said vertical wall and in the side wall of said bulb and means defining an outlet port from said chamber in said vertical wall and in said bulb side wall;

means defining an inlet passage in said housing spaced outwardly from said vertical wall and in communication with said inlet port and with said container;

means defining an outlet passage in said housing spaced outwardly from said vertical wall and in communication with said outlet port; and a flexible annular resilient flap clamped between said housing and said retainer plate and including valve means normally closing said inlet passage and normally closing said outlet passage, the walls of said inlet passage and said outlet passage being arranged with respect to said inlet and said outlet valve means such that the inlet valve will open said passage and the outlet valve will close said outlet passage when suction is created in said chamber and said inlet valve will close the inlet passage and said outlet valve will open the outlet passage when pressure is created within said chamber.

15. In a dispenser pump:

a flat flexible element for clamping between mating housing components having an internal cavity; and a pair of flexible flaps integral with and depending from said element forming valve means for controlling the flow of fluid through passages in said components leading into and out of said cavity, each flap having a large flat side surface to cover one of said passages with only one edge of each flap being attached to said element, and the length of each flap extending away from said element being considerably greater then the thickness of the flap so that the flap flexes freely away from said passage, and said side surface being supported against said components around said passage to prevent flexing toward said passage.

16. The pump of claim 15 including a deformable bulb forming said cavity, said bulb having closed bottom and side walls and open upper end, and said flexible element is an outwardly extending flange on the end of said bulb.

17. The pump of claim 16 wherein said bulb has a pair of valve ports in its side wall adjacent said flange and each radially aligned with a respective one of said flaps.

18. A dispenser pump comprising:

a housing having wall means defining an internal cavity open on its upper end including a shoulder around the cavity spaced below the open upper end means in said shoulder forming an inlet passage connecting the cavity to a container holding the product to be dispensed, and means in said shoulder forming an outlet passage connecting said cavity and an outlet nozzle;

means defining a variable volume pump chamber open to said cavity;

a cover plate closing the open upper end of said cavity having means depending into said cavity and cooperating with said housing shoulder to separate said inlet passage from said outlet passage; and a flexible valve element captured between said cover and said housing shoulder having an inlet portion extending over and closing said inlet passage and an outlet portion extending over and closing said outlet passage, said inlet portion permitting flow into said chamber but preventing flow out of said chamber, and said outlet portion permitting flow out of said chamber and preventing flow into said chamber.

19. The pump of claim 18 wherein said cover is spaced above said inlet and outlet portions so that such portions can flex upwardly into open positions.

20. The pump of claim 18 wherein said valve element has a central opening and a portion of said cover depending portions extends through said opening.

* * * * *